US005306984A

United States Patent [19]

Lee

[11] Patent Number: 5,306,984

[45] Date of Patent: Apr. 26, 1994

[54] PLASMA DISPLAY DEVICE

[75] Inventor: Sang-rok Lee, Seoul, Rep. of Korea

[73] Assignee: Samsung Electron Devices Co., Ltd., Kyunggi, Rep. of Korea

[21] Appl. No.: 875,287

[22] Filed: Apr. 29, 1992

[30] Foreign Application Priority Data

Aug. 24, 1991 [KR] Rep. of Korea ..... 91-14736

[51] Int. Cl.[5] ..... H01J 17/04; H01J 17/10

[52] U.S. Cl. ..... 313/484; 313/585; 313/587

[58] Field of Search ..... 313/484, 584, 585, 586, 313/587; 315/169.4

[56] References Cited

U.S. PATENT DOCUMENTS 4,423,352 12/1983 Miyazaki et al. ..... 313/584

4,999,541 3/1991 Kim et al. ..... 313/584

*Primary Examiner*—Sandra L. O'Shea

*Attorney, Agent, or Firm*—Leydig, Voit & Mayer

[57] ABSTRACT

A planar discharge plasma display device is disclosed, wherein common third signal lines, first signal lines for display discharge, and second signal lines for auxiliary discharge are formed on a rear plate, and barrier ribs for preventing cross-talk between pixels are formed together. Particularly, the signal lines and barrier ribs formed in the same direction constitute an accumulated structure so that the display discharge can be caused fast and stably, and also the occupation area of pixel per unit area is maximized, thereby realizing an image display of higher density.

4 Claims, 2 Drawing Sheets

PLASMA DISPLAY DEVICE

BACKGROUND OF THE INVENTION

The present invention relates to a plasma display device, and more particularly to a planar discharge plasma display device.

Generally, a direct current (DC) plasma display device is formed in such a manner that a plurality of stripe-like anodes and cathodes are arranged in the form of an X-Y matrix on each inner surface of two parallel substrates, and barrier ribs for preventing cross-talk between anodes are formed with a predetermined height. In such a plasma display device, the anodes and cathodes are exposed to an inner space filled with a discharge gas, so that a DC discharge is generated between the exposed upper anodes and lower cathodes, i.e., at a pixel, by a DC voltage sequentially supplied to each anode and cathode. However, the conventional plasma display device is disadvantageous in that the luminance deteriorates because the discharge light is transmitted through a transparent anode. Moreover, since the anodes and the cathodes which constitute pixels are separately formed on the front and rear plates, the fabrication process is difficult and complicated.

To solve the above problems, this inventor has suggested a plasma display device of a structure as shown in FIG. 1 (U.S. patent application Ser. No. 07/785,107, filed on Nov. 2, 1990).

In the suggested plasma display device, a plurality of anode signal lines 31' and cathode signal lines 41' in the form of an X-Y matrix are arranged on a rear plate 20' and a front plate 10' which are spaced at a predetermined distance. The both sets of signal lines 31' and 41' are isolated from the discharge space by the respective upper insulating layers 51' and 52'. A discharge electrode, e.g., an anode 30' and a cathode 40', is extruded and extended from the signal lines 31' and 41' with a certain pitch interval, and is exposed to the discharge space. Barrier ribs 60*a'* of a specified height are formed over and parallel to anode signal lines 31'.

The plasma display device having the aforementioned structure comprises a plurality of pixels in each of which an anode and a cathode spaced apart from each other at a predetermined distance are opposed near each intersection of an opposing anode signal line 31' and cathode signal line 41', which are insulated from each other. Accordingly, one signal line is selected by sequentially supplied scanning signals, thereby causing a discharge between the corresponding anode 30' and cathode 40', which is generated in the planar direction in parallel with the rear plate. The discharge light generated by the discharge is transmitted through to the front plate, to be visualized.

In the aforementioned plasma display device, since discharge is caused in the planar direction parallel to the rear plate, the discharge light is not lost through a transparent anode as in the conventional device and directly proceeds to the front plate. Accordingly, its luminance efficiency is higher than that of the aforementioned conventional plasma display device.

However, the plasma display device suggested by this inventor requires high breakdown voltage for initial discharging because discharge is caused only by directly supplying a voltage between the cathode and the anode. Accordingly, its response characteristic is bad because a certain amount of time is required until discharge starts, after supplying the voltage.

SUMMARY OF THE INVENTION

It is an object of the present invention to provide a plasma display device which has an improved structure, thereby shortening the start time of the main discharge for displaying a picture by an auxiliary discharge before the main discharge.

To achieve the object, the present plasma display device comprises:

a front plate and a rear plate which are spaced apart from each other by a predetermined interval, thereby forming a discharge space filled with a discharge gas;

stripe-like first and second signal lines which are sequentially stacked on the inner surface of the rear plate;

insulating layers which electrically insulate the first signal lines and the second signal lines from each other and also isolate them from the discharge space;

stripe-like third signal lines which are perpendicular to the first and second signal lines on the inner surface of the rear plate, thereby forming substantially square discharge regions together with the first and second signal lines;

stripe-like insulating layers for isolating the third signal lines from the discharge space;

discharge electrode groups which are exposed to the discharge space in every square discharge region and comprise first electrodes electrically connected to the first signal lines, second electrodes electrically connected to the second signal lines, and third electrodes electrically connected to the third signal lines; and barrier ribs of a predetermined height which prevent cross-talk between unit pixels composed of the first to third electrodes and form an accumulated structure with one of the first to third signal lines.

In this structure, the barrier ribs can form an accumulated structure by being accumulated with the first and second signal lines, and can also form another accumulated structure by being formed with the third signal lines.

BRIEF DESCRIPTION OF THE DRAWINGS

The above object and other advantages of the present invention will become more apparent by describing the preferred embodiment of the present invention with reference to the attached drawings, in which.

DETAILED DESCRIPTION OF THE INVENTION

Figure 1:
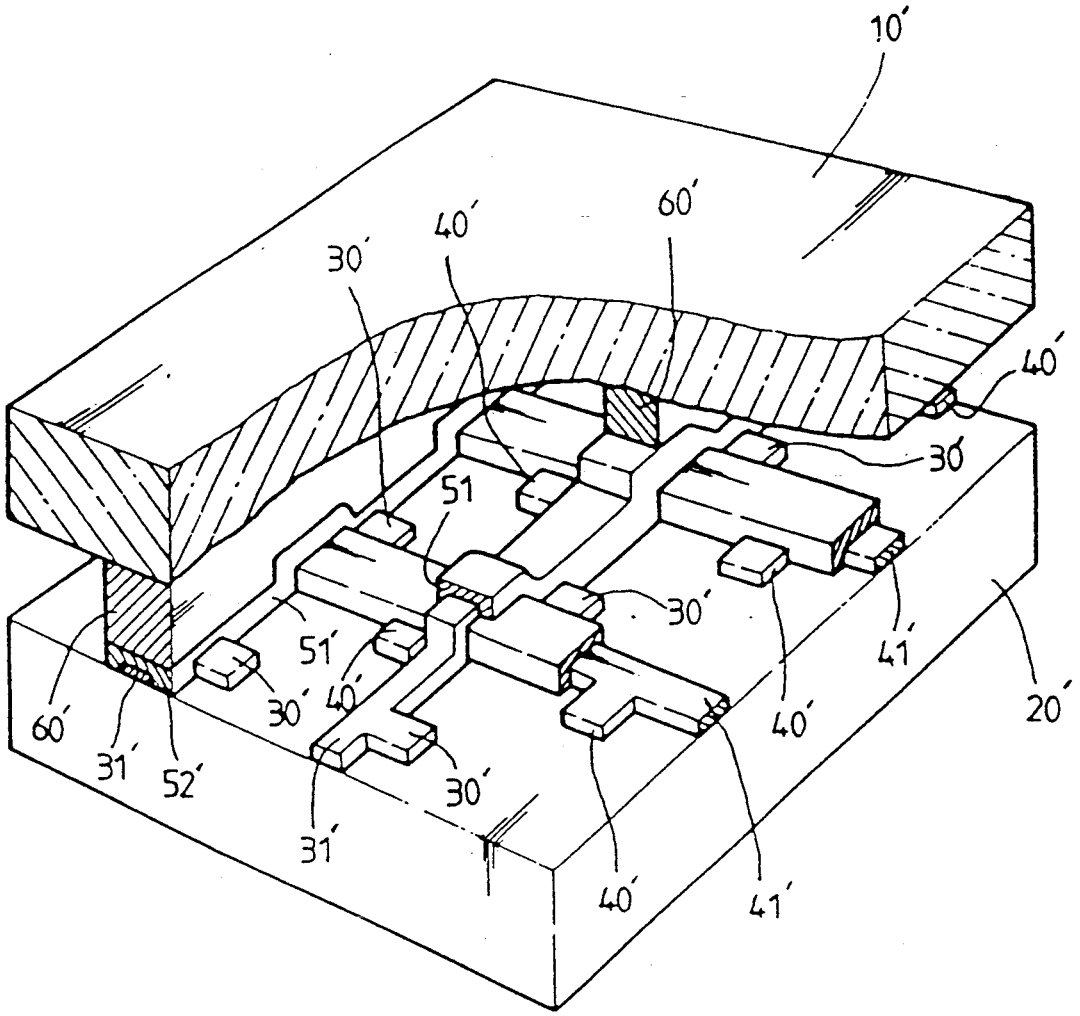
FIG. 1 is a partially broken perspective view of a conventional plasma display device.
Figure 2:
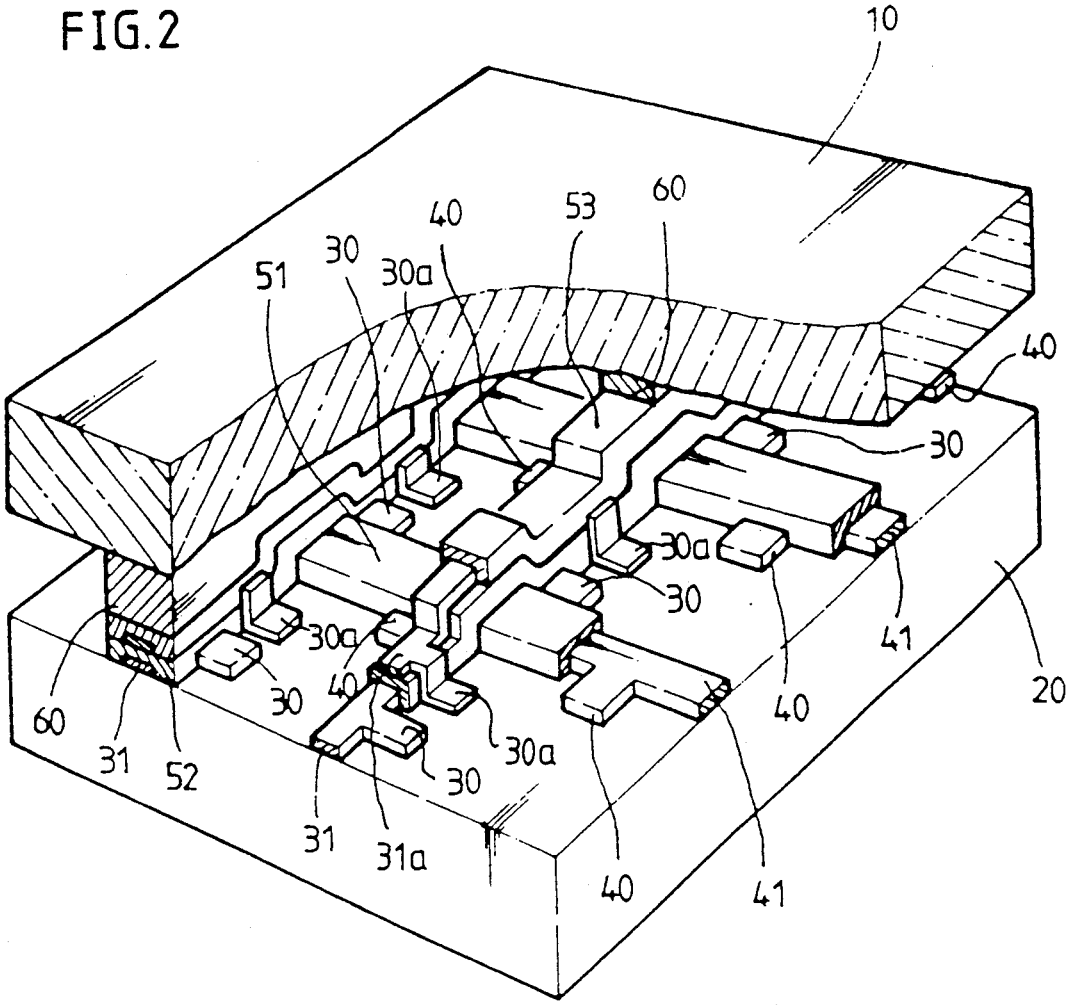
FIG. 2 is a partially broken perspective view of an embodiment of plasma display device according to the present invention.
Figure 3:
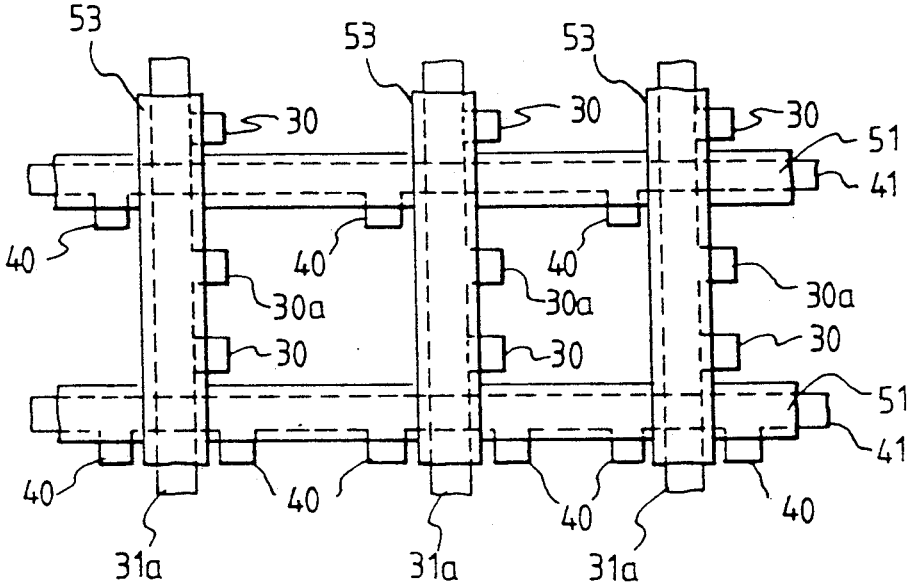
FIG. 3 is an extracted plan view of the plasma display device of the present invention shown in FIG. 2.

As shown in FIG. 2, a front plate 10 and a rear plate 20 are disposed with a predetermined distance, thereby forming a discharge space. A plurality of stripe-like first signal lines 31 and third signal lines 41 are disposed in the form of an X-Y matrix on the inner surface of rear plate 20, thereby providing substantially square discharge regions as shown in FIG. 3. Stripe-like second signal lines 31*a* are formed above the first signal lines 31, thereby forming a stacked structure together with the first signal lines.

Insulating layers 51, 52 and 53 are formed over first signal lines 31, second signal lines 31*a*, and third signal lines 41, so that the signal lines are electrically insulated from one another and at the same time, all are isolated from the discharge space.

In each square discharge region formed by the signal lines, a discharge electrode group having a first electrode 30, a second electrode 30*a*, and a third electrode 40 is provided for both auxiliary and main discharge. The electrodes are exposed to the discharge space, and are electrically connected with the corresponding signal lines. The first electrode 30 is electrically connected with first signal line 31, second electrode 30*a* is electrically connected with second signal line 31*a*, and third electrode 40 is electrically connected with third signal line 41. The electrodes are integrally formed with the respective corresponding signal lines and have been formed by the partial extension of the corresponding signal lines.

A barrier rib 60 of a predetermined height is formed above the second signal line 52. To prevent cross-talk, barrier rib 60 forms a stacked structure together with the lower first and second electrodes and the insulating layers. However, if necessary, the design of the barrier rib can be modified. For instance, barrier rib 60 can be disposed over and in the same direction as the third signal line, thereby forming a stacked structure together with the third signal line.

In the plasma display device of the present invention having the above structure, first signal line 31, the second signal line 31*a*, and third signal line 41 are mutually insulated and at the same time, are isolated from the discharge space, so that they cannot cause the discharge for the image display, and function as a conductor for transmitting an electrical signal to the respective corresponding electrodes.

The three electrodes provided on each of the square region form one pixel, in which one electrode is used as a common electrode and an auxiliary discharge is caused between the common electrode and another electrode, thereby forming a spatial charged particle. Then a display discharge is caused between the common electrode and the other electrode, thereby exciting one pixel for displaying an image. This discharge type is based on the conventional auxiliary discharge method, in which the third electrode is used as a common electrode, i.e., a cathode, the first electrode as a main anode, and the second electrode as an auxiliary anode.

In the plasma display device of the present invention, after spatial charged particles are generated by an auxiliary discharge, the display discharge continues. That is, if a voltage of a predetermined potential is supplied to the second and third signal lines by the sequentially scanned signal, a weak auxiliary discharge is generated between the dot-like opposing second and third electrodes provided on the same plane and at the intersection between them. Spatial charged particles are floated by such an auxiliary discharge in the discharge region where the second and third electrodes are disposed. Successively, if a predetermined voltage for display discharge is supplied between the first signal line and the third signal line which contributed to the auxiliary discharge, the display discharge is generated. With the help of the space charged particle generated through the auxiliary discharge, the display discharge can be generated quickly, even at a relatively low voltage.

Generally, in a plasma display device, a linear sequential driving method, that is, a method for exciting the whole screen line-by-line by simultaneously operating all pixels on one line, is adopted. In the present plasma display device, a voltage supplying method conforming to such a linear sequential driving method is adopted. The auxiliary discharge is wholly carried out along any selected one of the third signal lines which corresponds to the cathode. For this, a predetermined potential voltage for auxiliary discharge is supplied to one selected third signal line and all of the second signal lines perpendicularly crossed to the third signal line. Through this, the space charged particle by the auxiliary discharge is floated lengthwise of the selected second electrode. Successively, a predetermined potential voltage for display discharge is supplied to the selected third signal line and all of the first signal lines crossing the third signal line. At this time, the first signal lines are discriminated into voltage-supplied ones and no voltage-supplied ones according to the operation and non-operation of the corresponding pixel, respectively. Accordingly, the display discharge of one line for displaying an image is simultaneously carried out along the selected second signal line.

The aforementioned present plasma display device has an improved planar discharge structure and an auxiliary discharge structure of a preferred shape, thereby having advantages that fast and stable display discharge is realized and the discharge light generated through the display discharge can be used maximally.

That is, in the present plasma display device, since the first and second signal lines and the barrier ribs exist within a stacked structure, the occupation ratio of the discharge space to the whole screen can be maximized. Also, since the discharge light in the discharge space can be directly transmitted through the front plate, the loss of the discharge light is lower than that of the conventional one. An important characteristic of the present plasma display device is that in the disposition structure of the auxiliary electrode for general auxiliary discharge, as described above, the second signal line for auxiliary discharge exists in the stacked structure composed of the first signal lines and the barrier ribs, so that the discharge space for discharge is not reduced.

However, the aforementioned embodiment of the present invention is suited for a very simple structure among various complex plasma display devices to which the present invention is applicable. However, actually, it is preferred to be applied to those requiring very complex and high density image display.

What is claimed is:

1. A plasma display device comprising:

a front plate and a rear plate which are spaced apart from each other by a predetermined distance to form a discharge space;

stripe-like first signal lines and second signal lines which are sequentially stacked on an inner surface of said rear plate;

insulating layers surrounding said first and second signal lines which electrically insulate said first signal lines and said second signal lines from each other and at the same time, isolate said first and second signal lines from said discharge space;

stripe-like third signal lines which are perpendicular to said first and second signal lines disposed on the inner surface of said rear plate, thereby forming substantially square discharge regions together with said first and second signal lines;

stripe-like insulating layers surrounding said third signal lines for isolating said third signal lines from said discharge space;

discharge electrode groups which are exposed to the discharge space in every square discharge region, each of said discharge electrode groups comprises first electrodes electrically connected to said first signal lines, second electrodes electrically connected to said second signal lines, and third electrodes electrically connected to said third signal lines; and barrier ribs of a predetermined height stacked onto a structure composed of said first and second signal lines and said insulating layers for preventing cross-talk between unit pixels composed of said first, second and third electrodes.

2. A plasma display device as claimed in claim 1, wherein a barrier rib is laminated on a stacked structure composed of said first signal line and said second signal line, said barrier rib extending in a direction parallel to said first and second signal lines.

3. A plasma display device as claimed in claim 1, wherein said third signal line and said barrier rib are laminated together, thereby forming stacked structure wherein said barrier rib extends in a direction parallel to said third signal lines.

4. A plasma display device comprising:

a front plate and a rear plate which are spaced apart from each other by a predetermined distance to form a discharge space;

a number of first signal lines disposed on an inner surface of said rear plate arranged in parallel to each other;

a number of second signal lines respectively stacked in parallel on said first signal lines;

insulating layers covering said first and second signal lines which electrically insulate said first signal lines and said second signal lines from each other and which isolate said first and second signal lines from said discharge space;

third signal lines disposed on the inner surface of said rear plate and arranged perpendicular to said first and second signal lines, said first, second and third signal lines thereby forming substantially square discharge regions;

insulating layers covering said third signal lines and isolating said third signal lines from the discharge space;

first, second and third electrodes electrically connected to said first, second and third signal lines respectively, a first, second and third electrode comprising a pixel wherein one electrode is a common and an auxiliary discharge is caused between the common electrode and a first selected electrode and a display discharge is caused between the common electrode and a second selected electrode thereby exciting the pixel for displaying an image; and barrier ribs stacked onto one of said second and third signal lines to prevent cross-talk between pixels.

* * * * *